US006866027B1

(12) United States Patent
Marchesini et al.

(10) Patent No.: US 6,866,027 B1
(45) Date of Patent: Mar. 15, 2005

(54) THROTTLE BODY ASSEMBLY FOR A FUEL INJECTED COMBUSTION ENGINE

(75) Inventors: Stefano Marchesini, Sassomarconi (IT); Raffaele Terilizzi, Castelmaggiore (IT)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 10/664,113

(22) Filed: Sep. 17, 2003

(51) Int. Cl.[7] ..... F02D 9/08; F02M 51/00

(52) U.S. Cl. ..... 123/480; 123/337; 123/399; 123/635

(58) Field of Search ..... 123/336, 337, 123/399, 541, 542, 556, 557, 478, 634, 635, 143 C, 480, 361; 251/305

(56) References Cited

U.S. PATENT DOCUMENTS

| | | | | |
|---|---|---|---|---|
| 4,275,694 A | | 6/1981 | Nagaishi | |
| 4,355,293 A | | 10/1982 | Driscoll | |
| 4,512,314 A | | 4/1985 | Sakamoto et al. | |
| 4,543,914 A | | 10/1985 | Harris | |
| 4,557,225 A | | 12/1985 | Sagues et al. | |
| 4,561,396 A | | 12/1985 | Sakamoto et al. | |
| 4,649,367 A | | 3/1987 | Biermann et al. | |
| 4,655,238 A | | 4/1987 | Szlaga | |
| 4,671,242 A | | 6/1987 | Akiyama et al. | |
| 4,672,356 A | | 6/1987 | Biermann et al. | |
| 4,690,240 A | * | 9/1987 | Russo | 180/287 |
| 4,719,891 A | | 1/1988 | Porth et al. | |
| 4,730,255 A | | 3/1988 | Akiyama et al. | |
| 4,759,213 A | | 7/1988 | Porth et al. | |
| 4,766,869 A | | 8/1988 | de Concini et al. | |
| 4,884,215 A | | 11/1989 | Zboralski et al. | |
| 4,907,556 A | | 3/1990 | Ishii et al. | |
| 4,926,821 A | | 5/1990 | Porth et al. | |
| 4,933,661 A | | 6/1990 | Oda et al. | |
| 4,986,242 A | | 1/1991 | Bonfiglioli et al. | |
| 5,092,301 A | | 3/1992 | Ostdiek | |
| 5,094,212 A | | 3/1992 | Kawaguchi et al. | |
| 5,207,186 A | | 5/1993 | Okita | |
| 5,315,979 A | | 5/1994 | Kako | |
| 5,558,062 A | | 9/1996 | De Minco et al. | |
| 5,568,794 A | | 10/1996 | Tabuchi et al. | |
| 5,571,960 A | | 11/1996 | Tateishi et al. | |
| 5,608,632 A | | 3/1997 | White | |
| 5,718,202 A | | 2/1998 | Bentz et al. | |
| 5,756,890 A | | 5/1998 | Fedison, Jr. | |
| 5,868,114 A | | 2/1999 | Kaimimura et al. | |

(List continued on next page.)

FOREIGN PATENT DOCUMENTS

| | | | | |
|---|---|---|---|---|
| EP | 1108882 | * | 6/2001 | F02M/35/10 |
| JP | 2002/285866 | * | 10/2002 | F02D/9/10 |

*Primary Examiner*—Hai Huynh
(74) *Attorney, Agent, or Firm*—Reising, Ethington, Barnes, Kisselle, P.C.

(57) ABSTRACT

An air throttle body assembly having an integrated electronic control unit, ECU, is part of robust and compact electronic fuel injection system of a combustion engine. The ECU has an internal heat sensitive microprocessor located in an environmentally protected inner compartment of the ECU defined between an external surface of thermally conductive throttle body and a circuit board of the ECU. The throttle body has a through air passage for flowing of combustion air into the piston cylinder. The relatively cool and non-laminar flow of air also serves to cool the inner compartment of the ECU through the throttle body thus protecting the microprocessor from overheating. Moreover, a thermally conductive heat sink member of the ECU is exposed within the inner compartment and directly engages various heat producing transistors for transfer of heat by thermal conduction away from internal circuitry an into the surrounding environment outward from the throttle body assembly.

20 Claims, 3 Drawing Sheets

U.S. PATENT DOCUMENTS 5,988,119 A * 11/1999 Trublowski et al. ..... 123/41.31
6,386,151 B1 * 5/2002 Powell ..... 123/41.31
6,412,471 B1 * 7/2002 Trublowski et al. ..... 123/399
6,494,186 B1 * 12/2002 Wakeman ..... 123/479
2001/0045206 A1 * 11/2001 Smith et al. ..... 123/478

* cited by examiner

THROTTLE BODY ASSEMBLY FOR A FUEL INJECTED COMBUSTION ENGINE

FIELD OF THE INVENTION

The present invention relates generally to an electronic fuel injection system of a combustion engine and more particularly to an air throttle body assembly of the fuel-injected combustion engine having an integrated electronic control unit.

BACKGROUND OF THE INVENTION

Typically, an electronic fuel injection system, EFI, of a four-stroke combustion engine has an air throttle body for controlling the amount of air flowing through an engine head intake valve and into the combustion chamber of the engine block. At least one fuel injector of the EFI injects fuel directly into the air throttle body, or alternatively, into the piston cylinder to mix with the incoming air flowing through the throttle body. A spark plug or ignition system then ignites the resultant fuel-and-air mixture within the combustion chamber. The operation and sequential timing of each one of these components is dictated by a variety of engine operating parameters thus requiring various sensors which input into an electronic control unit, ECU, of the EFI system for processing in accordance with software instructions of a microprocessor of the ECU which then outputs signals to perform numerous functions.

The sensors typically include an air temperature sensor, an engine speed sensor, an engine temperature sensor, a pressure sensor, an air mass flow rate sensor and a throttle position sensor all disposed at various locations around the engine. These sensors provide input signals to the ECU which in turn provides output signals which control numerous drivers or power transistors of various components of the EFI system such as fuel injectors, an ignition coil, and a fuel pump. The power transistors, when energized by the output signals of the microprocessor generate heat and thus must be cooled and/or remotely located to avoid damaging the microprocessor.

Manufacturing of known EFI systems is complex, and requires various wiring harnesses, connectors and associated support structures routed or located about the engine to the appropriate sensors and components generally scattered throughout the engine vicinity. The overall system is thus bulky or cumbersome and generally hampers engine maintenance and increases cost. Moreover, excessive electrical connections located about the engine can lead to continuity and system failures caused by debris contamination. Moreover, poor heat management can be damaging to electronic components such as the microprocessor or printed circuit boards of the ECU, thus the ECU typically is located some distance away from the heat dissipating engine and the drivers spaced considerably away from the microprocessor. This contributes toward poor packaging of the engine, EFI system components and/or the entire product application.

SUMMARY OF THE INVENTION

An air throttle body assembly having an integrated electronic control unit, ECU, is part of a robust and compact electronic fuel injection system, EFI, of a combustion engine. The ECU has an internal heat sensitive microprocessor located in an environmentally protected inner compartment of the ECU defined between an external surface of a thermally conductive throttle body and a circuit board of the ECU. The throttle body carries a through air passage for flowing of combustion air into the engine combustion chamber. This relatively cool and non-laminar flow of air also serves to cool the inner compartment of the ECU via thermal conduction through the throttle body thus protecting the microprocessor from overheating. Moreover, a thermally conductive heat sink member of the ECU is exposed within the inner compartment and engages directly to various heat producing transistors for transferring of this heat by thermal conduction away from internal circuitry and into the surrounding environment outward from the throttle body assembly.

Preferably, the ECU has a cover engaged to the throttle body which defines an environmentally protected chamber wherein the circuit board is located. In addition to the inner compartment, the chamber has an outer compartment defined between a solder side of the circuit board and the cover through which the heat sink member laterally extends. Preferably, the remainder of the outer compartment is filled with an anti-corrosion material to protect the soldered connections of the circuit board.

Preferably, the ECU has a series of sensors, such as a throttle position sensor, an intake air temperature sensor and an air pressure sensor, disposed generally in the inner compartment and integrated into the throttle body to provide input signals to the microprocessor for controlling various, EFI and engine functions. Moreover, the EFI has at least one remote sensor which communicates an input signal into the microprocessor of the ECU via a wiring harness for controlling engine operating parameters.

Objects, features and advantages of this invention include an ECU carried and in part cooled by an air throttle body thus forming an easily assembled modular throttle body assembly with improved heat management attributes to protect heat sensitive circuitry. The compact throttle body assembly and integrated electronics reduces the complexity of the EFI system thus facilitating manufacture, assembly and maintenance. Moreover, the number of electrical connections and wiring harnesses are significantly reduced contributing to a more robust and overall lower cost EFI system and engine.

DESCRIPTION OF THE DRAWINGS

These and other objects, features and advantages of this invention will be apparent from the following detailed description of the preferred embodiments and test mode, appended claims, and accompanying drawings in which:

DETAILED DESCRIPTION OF THE PREFERRED EMBODIMENT

Figure 1:
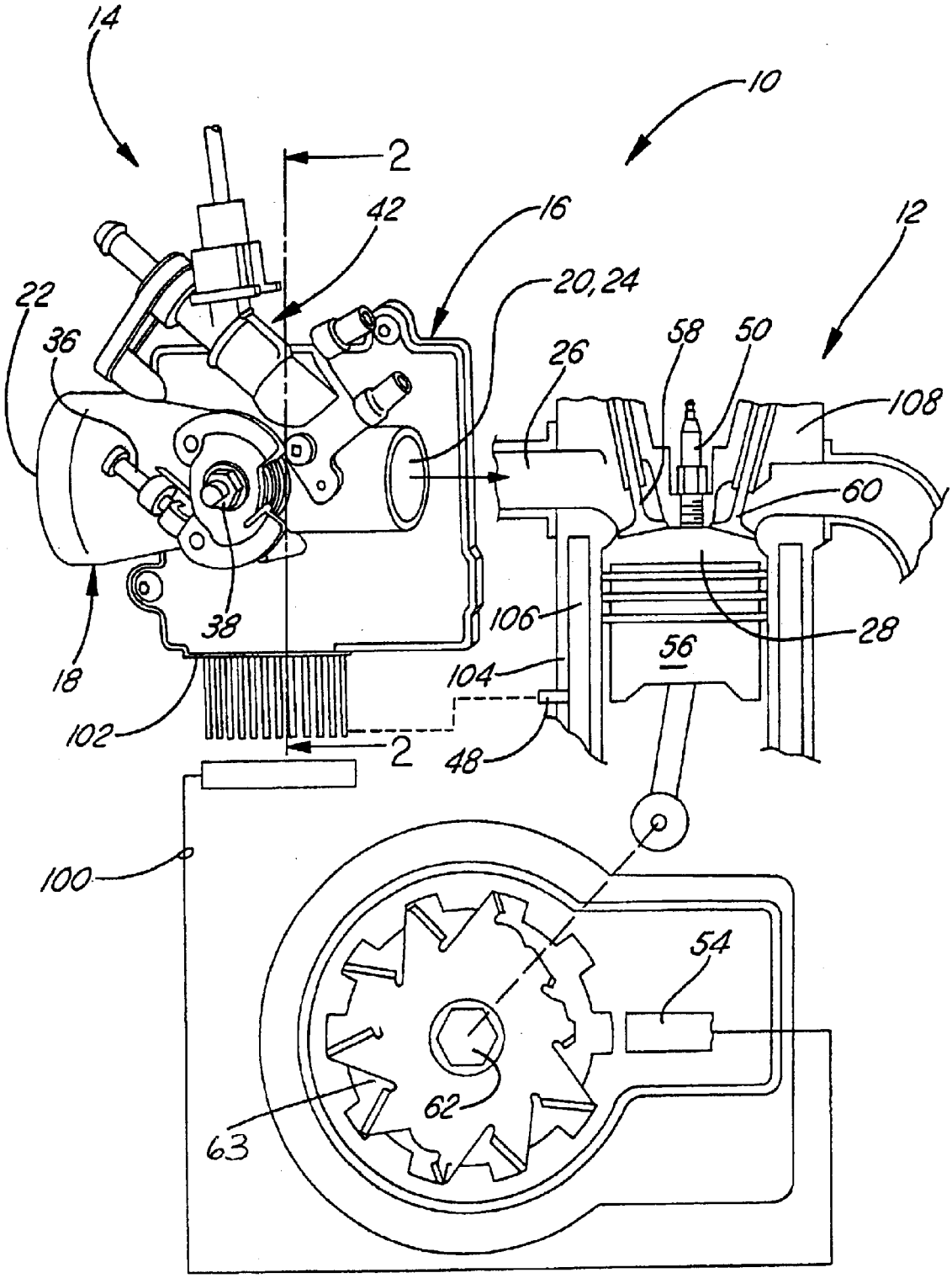
FIG. 1 is a partial semi diagrammatic sectional view of a combustion engine having an air throttle body assembly of the present invention.

Referring to FIGS. 1–4, an electronic fuel injection, EFI, system 10 of the present invention is preferably utilized on a four-stroke internal combustion engine 12 having an air throttle body assembly 14 which structurally integrates a series of sensors and an electronic control unit ECU 16 directly onto a throttle body 18 of the assembly 14. The throttle body 18 has a through air passage 20 having an inlet 22 which may be connected by a hose to an air filter (not shown) and an outlet 24 connected by another hose to an intake manifold 26 of the combustion engine 12. The intake manifold 26 generally communicates with a combustion chamber or piston cylinder 28 of the engine 12 during sequentially timed periods of a piston cycle. For a four-stroke engine application, as illustrated, the air flows through an open intake valve 58 during the sequentially timed period and directly into the piston cylinder 28. Alternatively, for a two-stroke engine application, typically air flows through the crankcase (not shown) before entering the combustion chamber portion of the piston cylinder through a port in the cylinder wall which is opened intermittently by the reciprocating piston.

Figure 2:
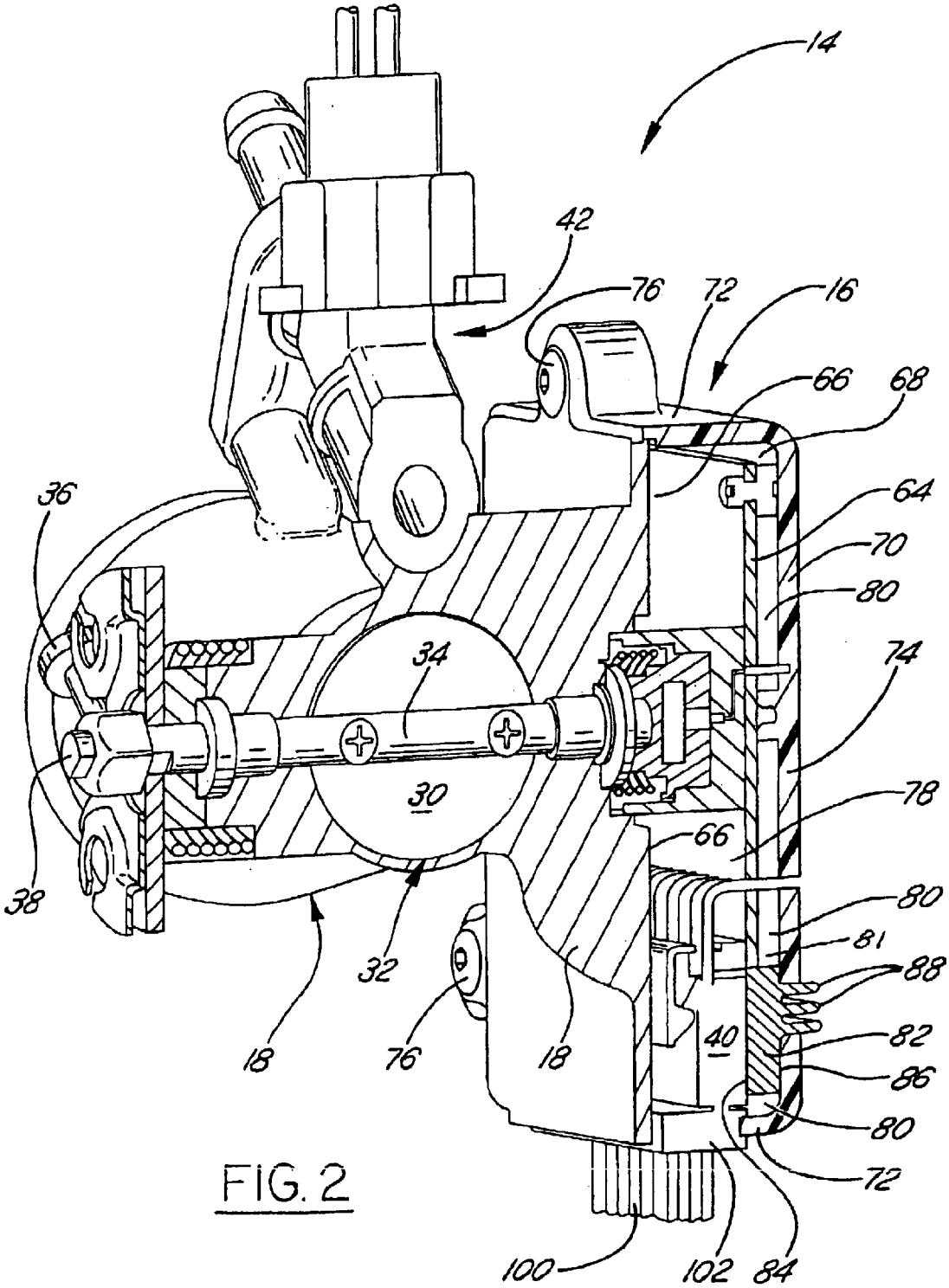
FIG. 2 is a perspective cross-section of the air throttle body assembly taken along line 2—2 of FIG. 1.
Figure 3:
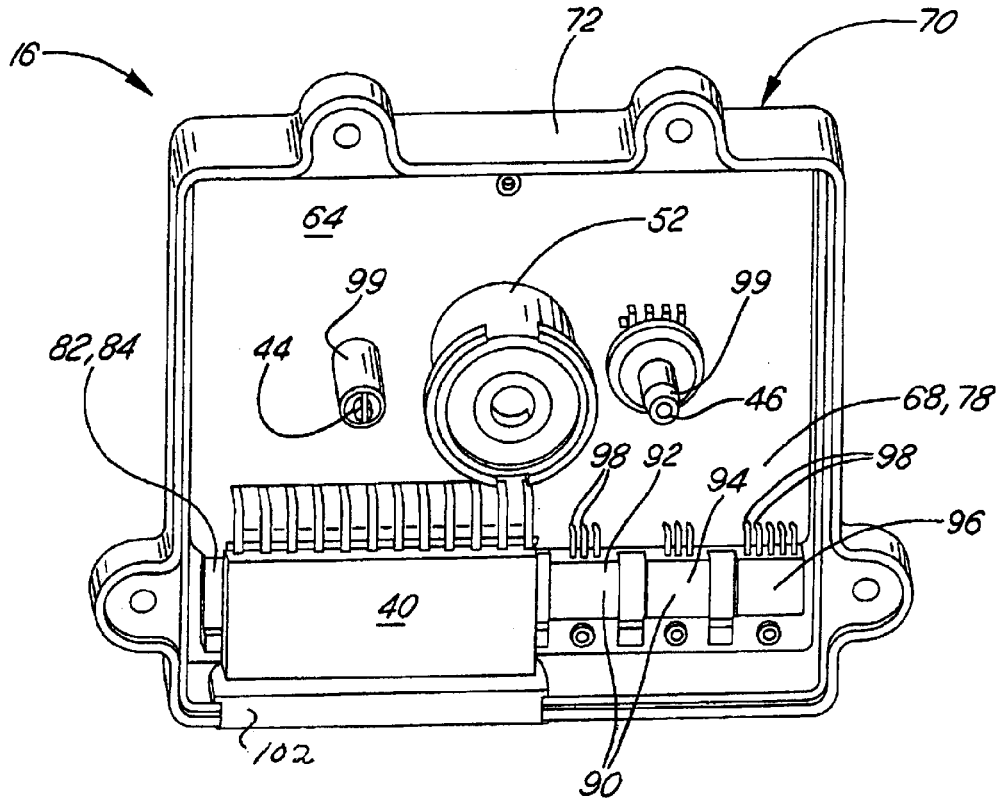
FIG. 3 is an internal perspective view of an electronic control unit of the air throttle body assembly.
Figure 4:
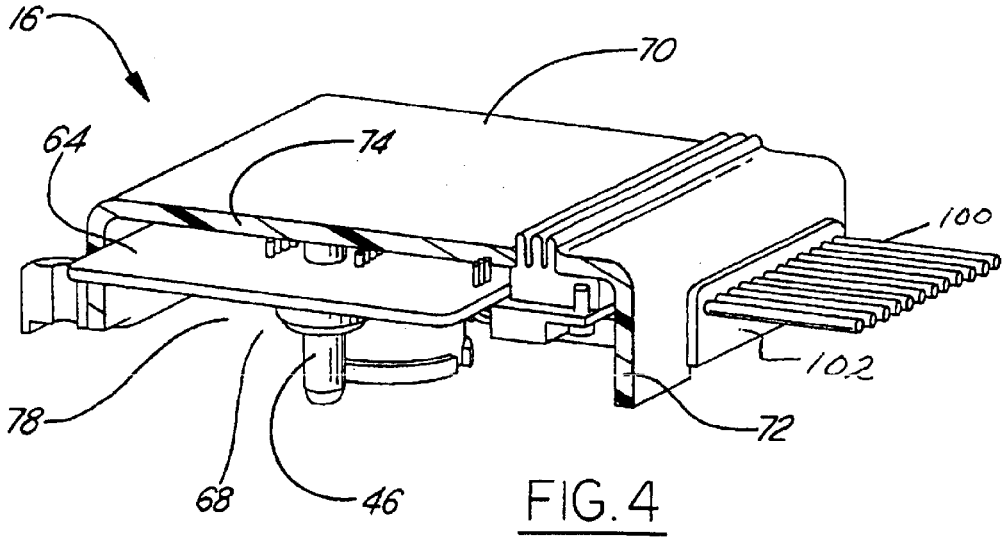
FIG. 4 is a perspective cross-section of the electronic control unit taken along line 4—4 of FIG. 3.

Referring to FIG. 2, regardless of whether the application utilizes a two or four-stroke combustion engine, the air flow rate through the air passage 20 of the throttle body 18 and into the engine 12 is controlled by a pivoting plate 30 engaged rigidly to a rotating throttle shaft 34 of a butterfly-type air throttle valve 32 disposed generally in the air passage 20. The shaft 34 extends laterally through the air passage 20 and throttle body 18 and is actuated by a mechanical linkage or Bowden 36 wire connected to a lever arm attached at one end 38 to the shaft 34 to manually rotate the shaft 34, thus opening and closing the throttle valve 32.

A microprocessor 40 of the ECU 16 controls numerous functions via internal software instructions which apply a fuel grid map, matrix or look up table in response to the sensed actual position of the throttle valve 32 versus engine rpm and crankshaft angular position in order to select the precise moment to open, and determine the opening duration of a fuel injector 42 which preferably injects pressurized fuel into the air passage 20 of the throttle body 18 for mixing with air and flowing the fuel-and-air mixture into the piston cylinder 28 of the engine 12.

The ECU 16 also accepts input signals from an intake air temperature sensor 44, an intake air pressure sensor 46, and at least one remote engine temperature sensor 48 to alter the basic fuel injector 42 open duration in view of these sensed parameters to provide a more precisely varied and controlled ratio of fuel-to-air.

Another grid map, matrix or look up table and software instruction, of the microprocessor 40 establishes when to apply an electric current to a spark plug 50 to ignite the fuel-and-air mixture in the piston cylinder 28 by receiving inputs from a throttle position sensor 52 and an engine speed and crank shaft angle sensor 54. That is, the ignition timing can be advanced or retarded depending upon such parameters as engine speed and engine load requirements. Moreover, the ECU 16 can also detect rapid accelerations of the combustion engine 12 by retaining a brief history of the rate of change of the throttle position and/or engine speed in order to modify or extend the basic duration of the injector open time to supply more needed fuel to the engine 12.

In operation, the strokes of the piston 56, inherent to the four-stroke combustion engine 12, are defined in sequential order as: a downward intake stroke, an upward compression stroke, a downward power stroke, and an upward exhaust stroke. During the downward intake stroke, the volume of the piston cylinder 28 above the piston 56 enlarges producing a vacuum pressure which causes air to flow through the throttle body 18 and into the combustion chamber 28 when the intake valve 58 is simultaneously opened via hydraulic lifters or a mechanical linkage (not shown) actuated by a separate camshaft or a crank shaft 62 of the engine 12 which is engaged concentrically to a flywheel 63. During the return or upward compression stroke, the intake valve 58 is closed typically by the bias of a spring and the fuel-and-air mixture within the piston cylinder 28 is compressed prior to combustion produced by ignition of the mixture by the sparking of the spark plug 50. The resultant combustion causes the downward power stroke which is followed by the upward exhaust stroke. During the exhaust stroke, an exhaust valve 60 constructed similarly to the intake valve 58 opens via a linkage actuated by a separate camshaft or the crank shaft 62, and the exhaust gasses are discharged from the combustion chamber.

For the sake of simplicity and reduced manufacturing costs particularly for small displacement engines, the ECU 16 of the throttle body assembly 14 does not discriminate between the intake and power strokes. That is, the speed sensor 54 and ECU 16 senses only the angular position of the crank shaft 62 of the engine 12. Consequently, the fuel injector 42 opens for one half of its total determined time for each upward stroke to achieve the desired fuel consumption. Because the intake valve 58 is closed during the power stroke, the fuel emitted from the injector 42 during the power stroke pools within the throttle body air passage 20 and becomes entrained in the flowing air when the intake valve 58 opens during the intake stroke.

The compact and simplistic design of the throttle body assembly 14 is particularly advantageous for relatively small displacement four-stroke engines 12 often having only one piston 56 where reduced weight and size, along with a degree of system simplicity, to minimize manufacturing costs has the greatest beneficial impact. That is the benefits of the throttle body assembly 14 of the present invention are particularly noticeable for small displacement engines 12 because it contributes to the reduction in overall engine size via improvements in engine packaging without complicating engine design or maintenance, which would otherwise lead to higher manufacturing costs.

Contributing toward this simplicity is the modular design of the throttle body assembly 14. For instance, the fuel injector 42 of the single piston engine 12 is not mounted to a head of the engine for direct injection into the combustion chamber. Instead, the fuel injector 42 is mounted to the throttle body 18 and injects fuel directly into the air passage 20 of the body 18. The fuel-and-air mixture then enters the piston cylinder 28 during the intake stroke. This enables a simpler and cost effective modular assembly of the engine. Moreover, with the fuel injector 42 mounted upstream of the engine intake valve 58, the speed sensor 54 need not differentiate between the intake and exhaust strokes, thus the sensor 54 and microprocessor 40 can be of a simpler and more cost effective design.

More specifically to the EFI system 10, the ECU 16 has a printed circuit board 64 upon which the air temperature sensor 44, the air pressure sensor 46 and the throttle position sensor 52 are structurally and electrically mounted, and an adjacent elongated aluminum heat sink member 82 upon which the microprocessor 40 and the component drivers 90 are mounted. The circuit board 64 is spaced outward from an exterior surface 66 of the throttle body 18 and is located in a protected environment or chamber 68 defined substantially by the exterior surface 66 and a dish-like plastic cover 70 of the ECU 16. Peripheral sides or walls 72 of the cover 70 project unitarily from the periphery of a preferably substantially planar member 74 of the cover 70 and are secured to the throttle body 18 via threaded bolts or fasteners 76. The heat sensitive microprocessor 40 is located in an inner compartment 78 of the chamber 68 defined substantially between the exterior surface 66 of the throttle body 18 and the circuit board 64.

To achieve an overall compact engine design, the ECU 16 is placed appreciably close to the heat producing engine block and thus must be cooled to protect internal electronic components such as the microprocessor 40 from over heating. Integration of the ECU with the throttle body 18 achieves this cooling while providing a robust and compact modular design. The inner compartment 78 of the ECU 16 is partially cooled by the ambient intake air flowing turbulently through the air passage 20 of the throttle body 18 when the engine 12 is running. Any heat gains within the inner compartment 78 (because of the close proximity of the ECU 16 to the hot engine block and due to the heat generated by internal electronic components such as the drivers 90) is dissipated or absorbed by convection at the cooler external surface 66 and is transferred by thermal conduction through the throttle body 18, made of aluminum or other thermally conductive material, and into the cooler non-laminar air flow of the air passage 20 by convection.

Because the heat producing drivers 90 are also located in the same compartment 78 as the heat sensitive microprocessor 40 for the purpose of dense packaging and simplification of engine assembly, heat produced by the drivers 90, and thus the negative effects it has upon the microprocessor 40 is eliminated by both the cooling of the air filled inner compartment 78, as previously described, and the thermal conduction of heat directly from the drivers 90, through the heat sink member 82 and into the external air environment outside of the ECU 16.

The heat sink member 82 extends laterally through an outer compartment 80 of the chamber 68 which is defined substantially between the circuit board 64 and the planar wall 74 of the cover 70. Compartment 80 is preferably filled substantially with a gel or epoxy filler 81 during manufacturing to encapsulate and protect the soldered circuitry connections of the circuit board 64 from oxidation, water, and debris entry. The elongated heat sink member 82 is defined laterally between an inward face 84 which directly seats on the microprocessor 40 and an outward face 86 from which a series of cooling ribs or fins 88 project laterally through the cover 70. Any heat build-up or hot spots created by the attached circuitry is transferred by thermal conduction through the heat sink member 82 and transmitted by convection into the surrounding air by way of the ribs 88.

Also seated directly against the inward face 84 of the heat sink member 82 are the various drivers or power transistors 90 which include a fuel pump driver 92, a fuel injector driver 94 and an ignition coil driver 96. Although not shown, a power supply for the microprocessor 40 can also be mounted directly to the heat sink member 82. Each transistor 90 has a series of leads 98 engaged electrically to the adjacent circuit board 64 for electrical communication with the circuitry and microprocessor.

To simplify assembly and reduce manufacturing costs, the intake air temperature sensor 44, the throttle position sensor 52 and the intake air pressure sensor 46 are integrated into the throttle body assembly 14. The sensors 44, 46, 52 mount electrically to the circuit board 64. The temperature and pressure sensors 44, 46 each have hollow tubular sleeves 99 which project from the circuit board 64 and snugly fit into a bore in the throttle body 18 to provide direct communication between the air passage 20 and the sensor 44, 46 which are thus sealed from the protected chamber 68 of the ECU 16. The throttle position sensor 52 is preferably a potentiometer mounted electrically on the circuit board 64 and connected or interfaced mechanically to an end of the rotating throttle shaft 34 which projects rotatably into the inner compartment 78 from the air passage 20.

Remotely located from the throttle body assembly 14 is the engine temperature sensor 48 and the crankshaft angular position and speed sensor 54. Both sensors are mounted directly on the engine 12 and connect electrically by suitable electrical cables or a wiring harness 100 to a connector 102 mounted on the ECU 16 and electrically connected to the adjacent microprocessor 40. For air cooled engines, the engine temperature sensor 48 is mounted on the piston cylinder wall 104 and in water cooled engines (as illustrated in FIG. 1) the sensor is disposed in the water jacket 106 to indicate the water temperature. The crank shaft position and engine speed sensor 54 is typically an electric coil disposed adjacent to the teeth of the engine flywheel 63 providing both a signal indicating the engine piston top dead center position and a series of signals indicating the angular position there-from throughout each revolution of the crank shaft 62. As previously described, in a four-stroke engine there are two complete revolutions of the crankshaft 62 for each power stroke of the piston 56.

In a modified form, the throttle body assembly 14 is the same as thus far described except that the throttle position sensor 52 is eliminated and the intake air pressure sensor 46 is located downstream of the closed throttle valve 32 and used to both; indicate the extent of the opening of the throttle valve by the change in the pressure sensed, and identify the intake stroke of the four cycle engine 12 (which produces the greatest pressure drop or change because the engine intake valve is open) for use in timing the fuel injection event so that it occurs only during the intake stroke. The internal software instructions of the microprocessor 40, previously described, are also modified by substituting the sensed intake air pressure for the throttle valve position, and the maximum pressure drop or change in use to indicate the engine intake stroke so that the injector opens to deliver fuel on only the intake stroke.

This modified form of the throttle body assembly 14 is particularly advantageous for larger engine displacement applications, especially those having multiple pistons 56 and fuel injectors 42 which can then be mounted to an engine head 108 for direct injection into the piston cylinder 28. Pooling of fuel within the throttle body 18 during every other cycle of the piston is thus eliminated. In such applications with larger engine displacements, fuel economy and emission standards are of a paramount concern.

In both forms of the system the ignition spark current can be supplied to the spark plug 50 on both the compression and exhaust strokes or if desired in the second form the air pressure sensor signal can also be used to cause the current to be applied to the spark plug 50, during only each compression stroke since it immediately follows the intake stroke.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit or scope of the invention.

We claim:

1. An air throttle body assembly of a combustion engine comprising:

an air throttle body having a through air passage and an exterior surface;

a throttle valve constructed and arranged within the air through passage for controlling air flow;

an electronic control unit integrated with the air throttle body, the electronic control unit having a cover engaged to the throttle body, a chamber defined directly between the cover and the exterior surface; and a heat sink member exposed within the chamber and projecting outward through the cover;

wherein the air throttle body is made of a thermally conductive material for transferring heat from the chamber into the air through passage; and wherein the heat sink member is made of a thermally conductive material for transferring heat through the cover.

2. The air throttle body assembly set forth in claim 1 comprising:

a circuit board of the electronic control unit disposed in the chamber;

an inner compartment of the chamber defined between the external surface and the circuit board; and wherein the heat sink member is exposed within the inner compartment.

3. The air throttle body assembly set forth in claim 2 comprising:

an outer compartment of the chamber defined between the circuit board and the cover; and wherein the heat sink member extends through the outer compartment.

4. The air throttle body assembly set forth in claim 3 wherein the outer compartment is filled with a corrosion preventing material.

5. The air throttle body assembly set forth in claim 2 further comprising a microprocessor of the electronic control unit disposed in the inner compartment, directly engaged mechanically to the heat sink member and engaged electrically to the circuit board.

6. The air throttle body assembly set forth in claim 5 comprising:

an end of a shaft of the throttle valve disposed in the inner compartment;

a position sensor of the electronic control unit disposed in the inner compartment and engaged electrically to the circuit board; and wherein the position of the throttle valve is monitored by the microprocessor.

7. The air throttle body assembly set forth in claim 5 comprising:

an intake air temperature sensor of the electronic control unit constructed and arranged to sense air temperature within the air through passage; and wherein the intake air temperature sensor is engaged electrically to the circuit board and wherein the intake air temperature is monitored by the microprocessor.

8. The air throttle body assembly set forth in claim 7 comprising:

a sleeve engaged between the throttle body and the circuit board; and wherein the intake air temperature sensor is disposed within the sleeve for providing communication with the air through passage.

9. The air throttle body assembly set forth in claim 5 comprising:

an intake air pressure sensor of the electronic control unit constructed and arranged to sense air pressure within the air through passage; and wherein the intake air pressure sensor is engaged electrically to the circuit board for monitoring of air pressure by the microprocessor.

10. The air throttle body assembly set forth in claim 9 comprising:

a sleeve engaged between the throttle body and the circuit board; and wherein the intake air pressure sensor is disposed within the sleeve for providing communication with the air through passage.

11. The air throttle body assembly set forth in claim 5 further comprising a fuel injector mounted to the throttle body and controlled by the microprocessor for injecting liquid fuel into the air through passage downstream of the throttle valve.

12. The air throttle body assembly set forth in claim 5 wherein the heat sink member has a plurality of elongated ribs projecting laterally outward of the cover for transferring beat from the heat sink member by convection.

13. The air throttle body assembly set forth in claim 12 comprising:

a plurality of drivers disposed in the inward compartment and engaged directly to the heat sink member; and wherein the drivers communicate electrically with the circuit board.

14. The air throttle body assembly set forth in claim 13 wherein the plurality of drivers include an ignition coil transistor, a fuel pump transistor, and a fuel injector transistor.

15. An electronic fuel injection system of a four-stroke combustion engine having an engine block carrying a piston cylinder for guiding a reciprocating piston engaged to a crankshaft, a flywheel engaged concentrically to the crankshaft, an intake valve synchronized with the crankshaft for sequentially flowing a mixture of fuel-and-air into the combustion chamber of the piston cylinder during an intake stroke of the piston, and a spark plug mounted to the engine block and communicating with the combustion chamber for igniting the mixture of fuel-and-air during a compression stroke, the electronic fuel injection system comprising:

a throttle body having a through passage communicating with the combustion chamber when the intake valve is open during the intake stroke;

a throttle valve constructed and arranged within the through passage for controlling the air flow;

a circuit board engaged to the throttle body;

an inner compartment defined by the throttle body and the circuit board;

wherein the throttle body is made of a thermally conductive material for transferring heat from the inner compartment into the throttle body by thermal convection, through the throttle body by thermal conduction and into the through passage by thermal convection;

a heat sink member exposed within the inner compartment and disposed adjacent the circuit board;

a microprocessor located in the inner compartment; and at least one driver engaged directly to the heat sink member wherein heat generated by the driver is transferred away from the inner compartment and into the heat the sink member by thermal conduction and out of the heat sink member away from the inner compartment by thermal convection.

16. The electronic fuel injection system set forth in claim 15 comprising:

a fuel injector transistor of the at least one driver controlled by the microprocessor;

a fuel injector mounted to the throttle body and exposed within the air passage for injecting liquid fuel into the through passage downstream of the throttle valve; and wherein the fuel injector transistor electrically powers the fuel injector.

17. The electronic fuel injection system set forth in claim 16 comprising:

an ignition coil transistor of the at least one driver controlled by the microprocessor; and wherein the ignition coil transistor electrically powers the spark plug.

18. The electronic fuel injection system set forth in claim 17 comprising:

a fuel pump transistor of the at least one driver controlled by the microprocessor;

a fuel pump constructed and arranged to supply liquid fuel at a controlled pressure to the fuel injector; and wherein the fuel pump transistor electrically powers the fuel pump.

19. The electronic fuel injection system set forth in claim 15 wherein the microprocessor is engaged directly to the heat sink member.

20. The electronic fuel injection system set forth in claim 15 comprising:

an end of a rotating shaft of the throttle valve disposed in the inner compartment;

a position sensor of the electronic control unit disposed in the inner compartment and engaged electrically to the circuit board, wherein the position of the throttle valve is monitored by the microprocessor;

an intake air temperature sensor of the electronic control unit constructed and arranged to sense air temperature within the air through passage, wherein the intake air temperature sensor is engaged electrically to the circuit board and wherein the intake air temperature is monitored by the microprocessor; and an intake air pressure sensor of the electronic control unit constructed and arranged to sense air pressure within the air through passage, wherein the intake air pressure sensor is engaged electrically to the circuit board for monitoring of air pressure by the microprocessor.

* * * * *

UNITED STATES PATENT AND TRADEMARK OFFICE

CERTIFICATE OF CORRECTION

PATENT NO. : 6,866,027 B1
DATED : March 15, 2005
INVENTOR(S) : Stefano Marchesini et al.

It is certified that error appears in the above-identified patent and that said Letters Patent is hereby corrected as shown below:

Column 10,
After line 21, please add the following claims 21 and 22:

21. The electronic fuel injection system set forth in claim 20 comprising:

a speed sensor located remotely from the throttle body and constructed and arranged to sense the rotational speed of the flywheel; and a wire harness engaged electrically between the microprocessor and the speed sensor for monitoring of an input speed signal from the speed sensor by the microprocessor.

22. The electronic fuel injection system set forth in claim 15 comprising:

a speed sensor located remotely from the throttle body and constructed and arranged to sense the rotational speed of the flywheel;

an engine temperature sensor located remotely from the throttle body and mounted to the engine block; and a wire harness engaged electrically between the microprocessor and the speed and engine temperature sensors for monitoring of input speed signals by the microprocessor.

Signed and Sealed this

Thirty-first Day of May, 2005

JON W. DUDAS
*Director of the United States Patent and Trademark Office*